US010774589B2

(12) United States Patent
Diecke

(10) Patent No.: US 10,774,589 B2
(45) Date of Patent: Sep. 15, 2020

(54) MAST WITH HYDRAULIC CIRCUIT FOR ASSIST CYLINDER

(71) Applicant: Caterpillar Global Mining Equipment LLC, Denison, TX (US)

(72) Inventor: Friedrich K. Diecke, Holly Spring, NC (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 16/028,498

(22) Filed: Jul. 6, 2018

(65) Prior Publication Data

US 2020/0011353 A1 Jan. 9, 2020

(51) Int. Cl.

| | |
|---|---|
| ***E21B 7/02*** | (2006.01) |
| ***E21B 15/04*** | (2006.01) |
| ***F15B 11/20*** | (2006.01) |
| ***E21B 15/00*** | (2006.01) |
| ***E04H 12/34*** | (2006.01) |
| ***F15B 15/06*** | (2006.01) |
| ***F15B 13/02*** | (2006.01) |

(52) U.S. Cl.

CPC ..... *E21B 7/02* (2013.01); *E04H 12/345* (2013.01); *E21B 15/00* (2013.01); *E21B 15/045* (2013.01); *F15B 11/20* (2013.01); *F15B 13/024* (2013.01); *F15B 15/06* (2013.01); *F15B 2211/329* (2013.01); *F15B 2211/55* (2013.01); *F15B 2211/7053* (2013.01); *F15B 2211/71* (2013.01); *F15B 2211/781* (2013.01)

(58) Field of Classification Search

None

See application file for complete search history.

(56) References Cited

U.S. PATENT DOCUMENTS

| | | | | |
|---|---|---|---|---|
| 2,657,906 | A * | 11/1953 | Richards | E21B 15/04 173/147 |
| 2,703,634 | A * | 3/1955 | Lee | B66C 13/18 52/115 |
| 3,205,627 | A * | 9/1965 | Gyongyosi | E21B 15/04 52/115 |
| 3,721,304 | A | 3/1973 | Hanson | |
| 4,158,393 | A | 6/1979 | Kimber et al. | |
| 4,194,419 | A * | 3/1980 | Mitchhart | E21B 19/20 81/57.33 |

(Continued)

FOREIGN PATENT DOCUMENTS

| | | |
|---|---|---|
| CN | 205277958 | 6/2016 |
| CN | 105134091 | 7/2017 |
| JP | 4880642 | 2/2012 |

*Primary Examiner* — Abiy Teka

*Assistant Examiner* — Michael Quandt

(74) *Attorney, Agent, or Firm* — Oblon, McClelland, Maier & Neustadt LLP

(57) ABSTRACT

A mast assembly that includes a mast and a hydraulic circuit for moving the mast. The hydraulic circuit includes a primary hydraulic cylinder coupled to the mast to rotate the mast about a pivot axis and a secondary hydraulic cylinder extending from a rod end to a cap end that is fluidly coupled to the primary hydraulic cylinder. A directional valve is fluidly coupled between the primary hydraulic cylinder and secondary hydraulic cylinder to keep a pressure on the cap end of the secondary hydraulic cylinder greater than the pressure on the rod end of the secondary hydraulic cylinder during all operating conditions.

16 Claims, 4 Drawing Sheets

(56) References Cited

U.S. PATENT DOCUMENTS

| | | | | |
|---|---|---|---|---|
| 4,938,296 | A * | 7/1990 | Brazell, II | E21B 7/022 173/164 |
| 5,896,935 | A | 4/1999 | Esko et al. | |
| 9,404,323 | B2 | 8/2016 | Swanson | |
| 2018/0149174 | A1 | 5/2018 | Zapico et al. | |

* cited by examiner

MAST WITH HYDRAULIC CIRCUIT FOR ASSIST CYLINDER

TECHNICAL FIELD

This disclosure relates to mast drilling machines. More particularly, to a hydraulic circuit for controlling the angle of the mast drilling machine.

BACKGROUND

Mast drilling machines are utilized in surface mining operations where the mast drilling machine drills bores in rocks and other materials in desired locations. The mast is movably coupled to a vehicle such as a truck for transportation. In operation, a lift system moves the mast from the transport position to an operation or drilling position. When in a drilling position the vehicle functions as a counterweight or base for the mast to prevent the mast from tipping over, causing significant damage and danger.

The lift system rotates the mast about a pivot axis from the transport position to the drilling position. The drilling position can occur when the mast is perpendicular (at 90°) to the ground. Alternatively, during operation, drilling is desired at an angle, not only at angles less than 90° degrees, where the machine is disposed between the mast and the ground, but also at angles past 90° degrees such as up to 105° degrees when the mast is angled away from the vehicle. Specifically, linkage is proved to hold the mast in such position without tipping as a result of vibrations during the drilling process.

Japanese Patent Publication No. 4880642B2 provides a vehicle mounted mast device with framework supporting the device on the vehicle. Linkage, including a hydraulic system is utilized to support the mast and move the mast into desired locations. Still, hydraulic systems can be complicated, expensive to manufacture, and prone to fatigue and wear. Specifically, the hydraulic device or cylinder responsible for supporting and rotating the mast is subject to significant forces resulting in wear, fatigue, strain, malfunction, and the like.

SUMMARY OF THE INVENTION

In one aspect of the invention a mast assembly is provided that includes a mast and a hydraulic circuit coupled to the mast. The hydraulic circuit includes a primary hydraulic cylinder coupled to the mast to rotate the mast about a pivot axis and a secondary hydraulic cylinder extending from a rod end to a cap end, fluidly coupled to the primary hydraulic cylinder. The hydraulic circuit also includes a directional valve fluidly coupled between the primary hydraulic cylinder and secondary hydraulic cylinder to maintain pressure on the cap end of the secondary hydraulic cylinder greater than a pressure on the rod end of the secondary hydraulic cylinder in a first position and in a second position.

In another aspect of the invention, a hydraulic circuit is provided. The hydraulic circuit includes a primary hydraulic cylinder and a secondary hydraulic cylinder extending from a rod end to a cap end, fluidly coupled to the primary hydraulic cylinder. A directional valve is fluidly coupled between the primary hydraulic cylinder and the rod end of the secondary hydraulic cylinder. The hydraulic circuit also includes a relief valve coupled between the directional valve and the cap end of the secondary hydraulic cylinder.

In yet another aspect of the invention, a method for pivoting a mast through working positions is provided. A primary hydraulic cylinder is activated to move a mast through a first arc. A secondary hydraulic cylinder is engaged by the mast as the mast moves through a second arc and reduces load on the primary hydraulic cylinder as the mast moves through the second arc.

DETAILED DESCRIPTION

Figure 1:
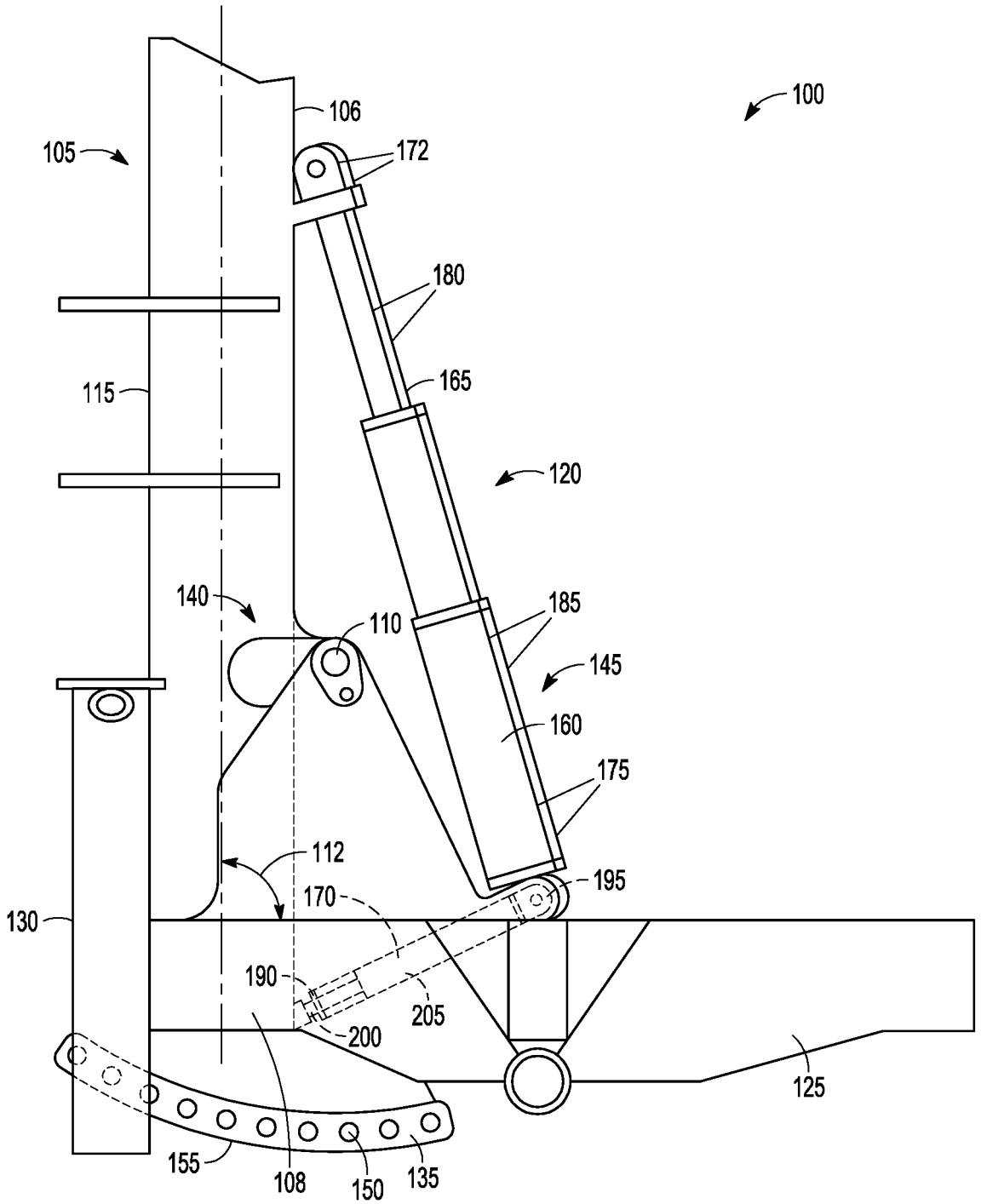
FIG. 1 shows a diagrammatic illustration of an exemplary mast assembly.
Figure 2:
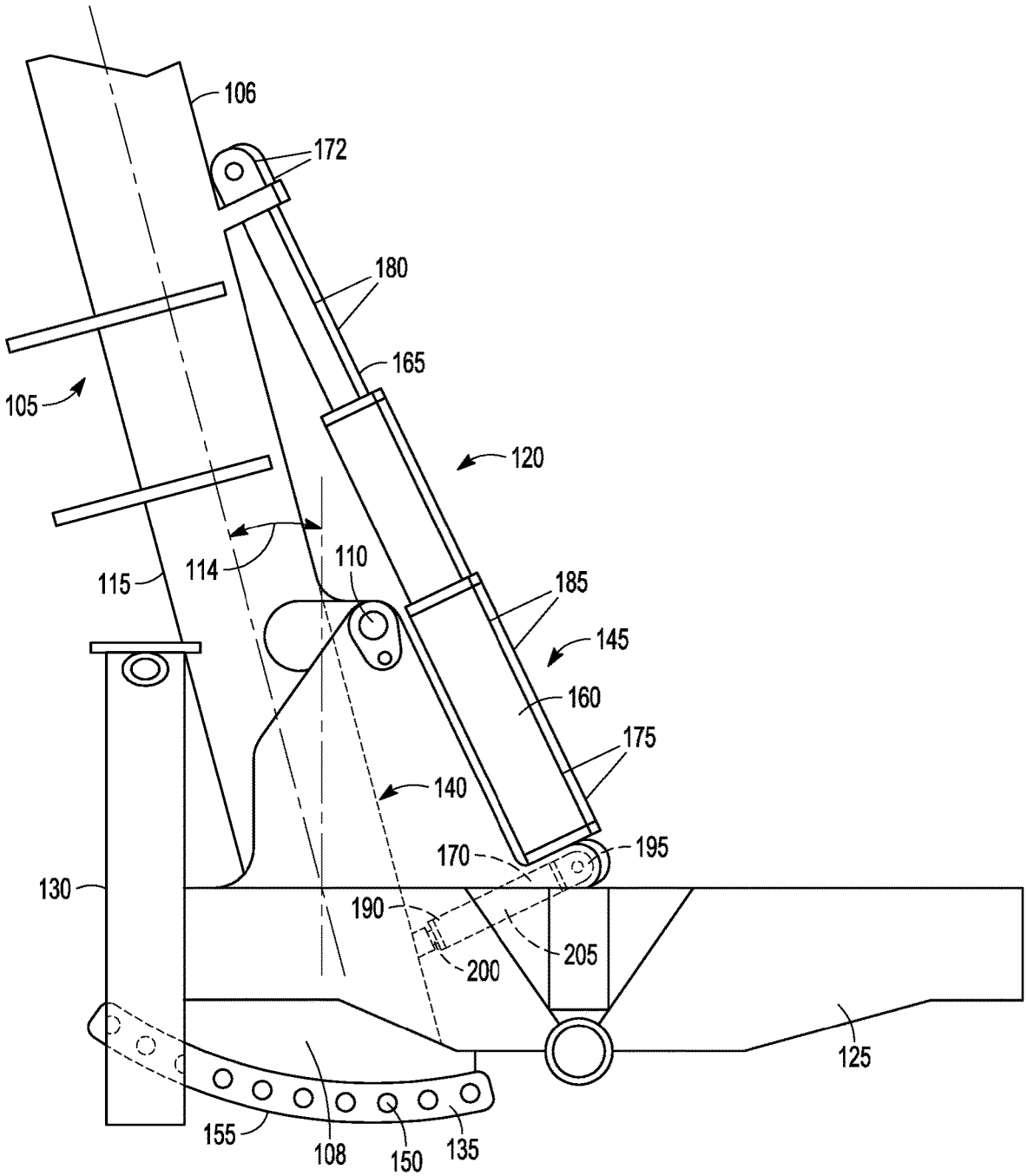
FIG. 2 shows a diagrammatic illustration of an exemplary mast assembly.

FIGS. 1 and 2 illustrate a mast assembly 100 with a mast 105 that extends from a first end 106 to a second end 108 and moves from a 90° operating position, relative to a horizontal surface, in FIG. 1 to a 105° operating position in FIG. 2. While only the mast assembly 100 is illustrated, the mast assembly 100 is coupled to a vehicle such as a truck, or other counterweight that is omitted from the figures to provide better detail related to the mast assembly 100. While illustrated as positioned at 90° and 105° degrees, the mast 105 also moves from a transport position and rotates about a pivot axis 110 from 0° to 105° degrees. Specifically, the mast rotates through a first arc 112 that in one example is between 0° and 90° and a second arc 114 that in one example is between 90° and 105°. The mast 105 includes a support framework 115 that supports an operational implement that in one example is a drill. A mast pivot system 120 is coupled to the mast 105 and pivots the mast 105 about the pivot axis 110 from a transportation position to a drilling position that includes a range of 0° to 105°.

The mast pivot system 120 includes a support base frame 125, leg members 130, an arcuate plate 135, and linkage 140 including a hydraulic support system 145. The support base frame 125 receives the leg members 130 and is coupled to the vehicle to provide counterbalance for the mast 105.

The arcuate support plate 135 is coupled to the support base frame 125 and linkage 140 and includes a plurality of openings 150 at its periphery 155 for receiving a pin to lock the mast at predetermined angles. Specifically, each opening 150 represents a pre-determined angle and by connecting the end of the mast to the arcuate plate 135, undesired movement of the mast 105 during operation is prevented.

The hydraulic support system 145 includes a first primary hydraulic cylinder 160, a second primary hydraulic cylinder 165, and a secondary hydraulic cylinder 170 that is coupled to the linkage 140 to pivot the mast 105 about the pivot axis 110. The first and second primary hydraulic cylinders 160, 165 are coupled to the support base frame 125. In one embodiment, the cylinders are spaced apart and positioned parallel to one another. While first and second primary hydraulic cylinders 160, 165 are provided in this example, in other examples only a single primary hydraulic cylinder is utilized. Each hydraulic cylinder 160, 165 extends from a rod end 172 that secures to first end 106 of the mast 105 to a cap end 175, or piston end that is coupled to the support base frame 125. Each primary hydraulic cylinder 160, 165 also includes a rod element 180 that secures to the framework 115 and is disposed within the cylinder body 185 to extend or retract from the cylinder body 185 based upon the fluid pressure within the cylinder body 185.

The secondary hydraulic cylinder 170 extends from a rod end 190 to a cap end 195 that is coupled to the support base frame 125 between the first primary hydraulic cylinder 160 and second primary hydraulic cylinder 165. The secondary hydraulic cylinder 170 includes a rod element 200 and head or piston element (not shown) that are disposed within the cylinder body 205 to extend or retract from the cylinder body 205 based upon the fluid pressure within the cylinder body 205. The rod element 200 extends from the cylinder body 205 and is coupled to a plate element (not shown) that is supported by linkage. Specifically, the secondary hydraulic cylinder is only provided to supplement the first and second primary hydraulic cylinders 160, 165 when the mast 105 is positioned in a predetermined range that in one example is between 90°-105°. Consequently, the secondary hydraulic cylinder 170 is positioned adjacent the second end 108 of the mast 105 and does not engage the mast 105 until the mast 105 rotates to a predetermined angle, such as the 90° position. At this point the second end 108 of the mast 105 engages the plate element (not shown) to place a force on the rod element 200 inwardly into the cylinder body 205. The plate element and support linkage allow some movement of the mast 105 against the plate element, but prevents undesired movement.

Figure 3:
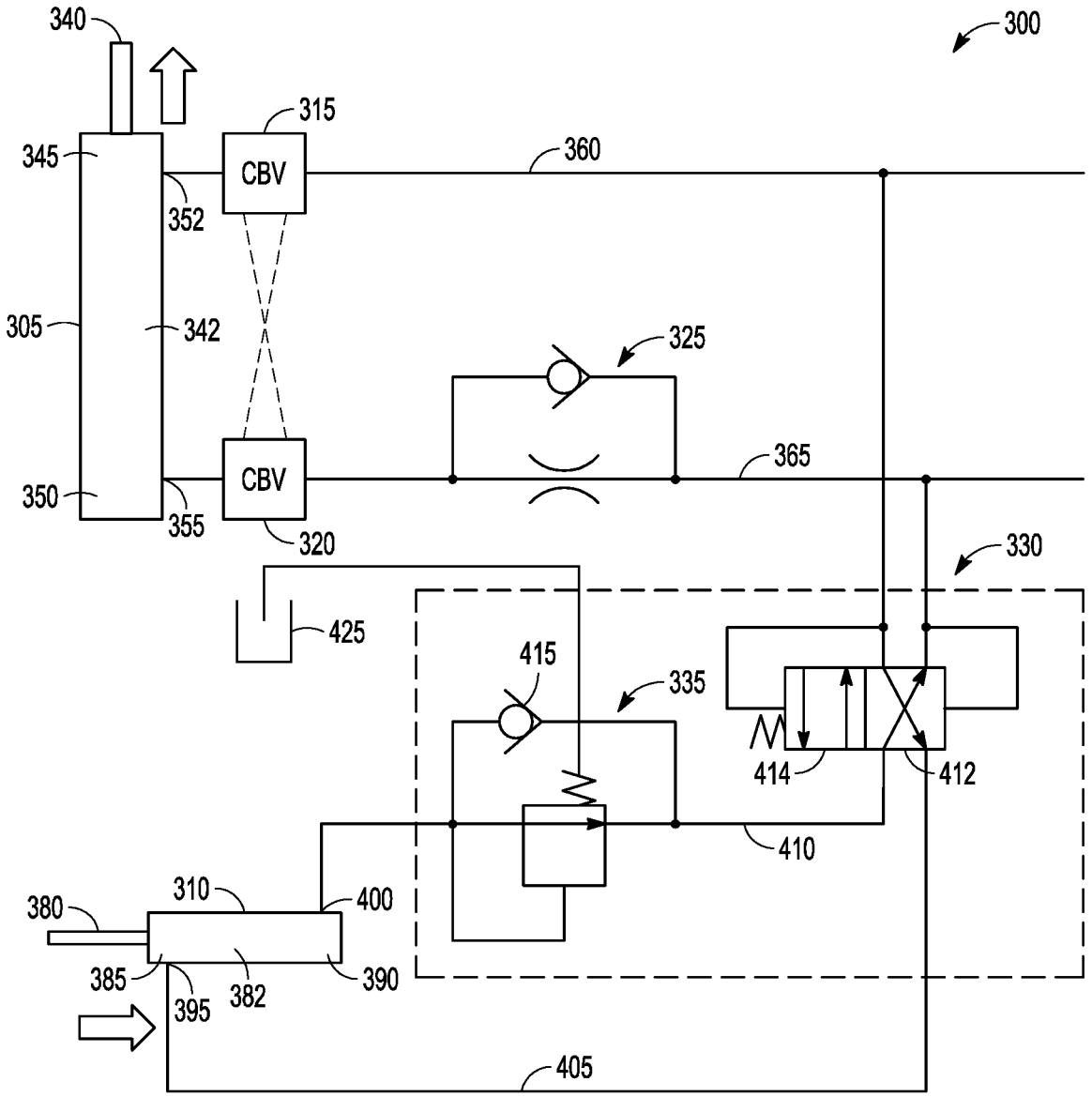
FIG. 3 shows a schematic diagram of a hydraulic circuit for an exemplary mast assembly.
Figure 4:
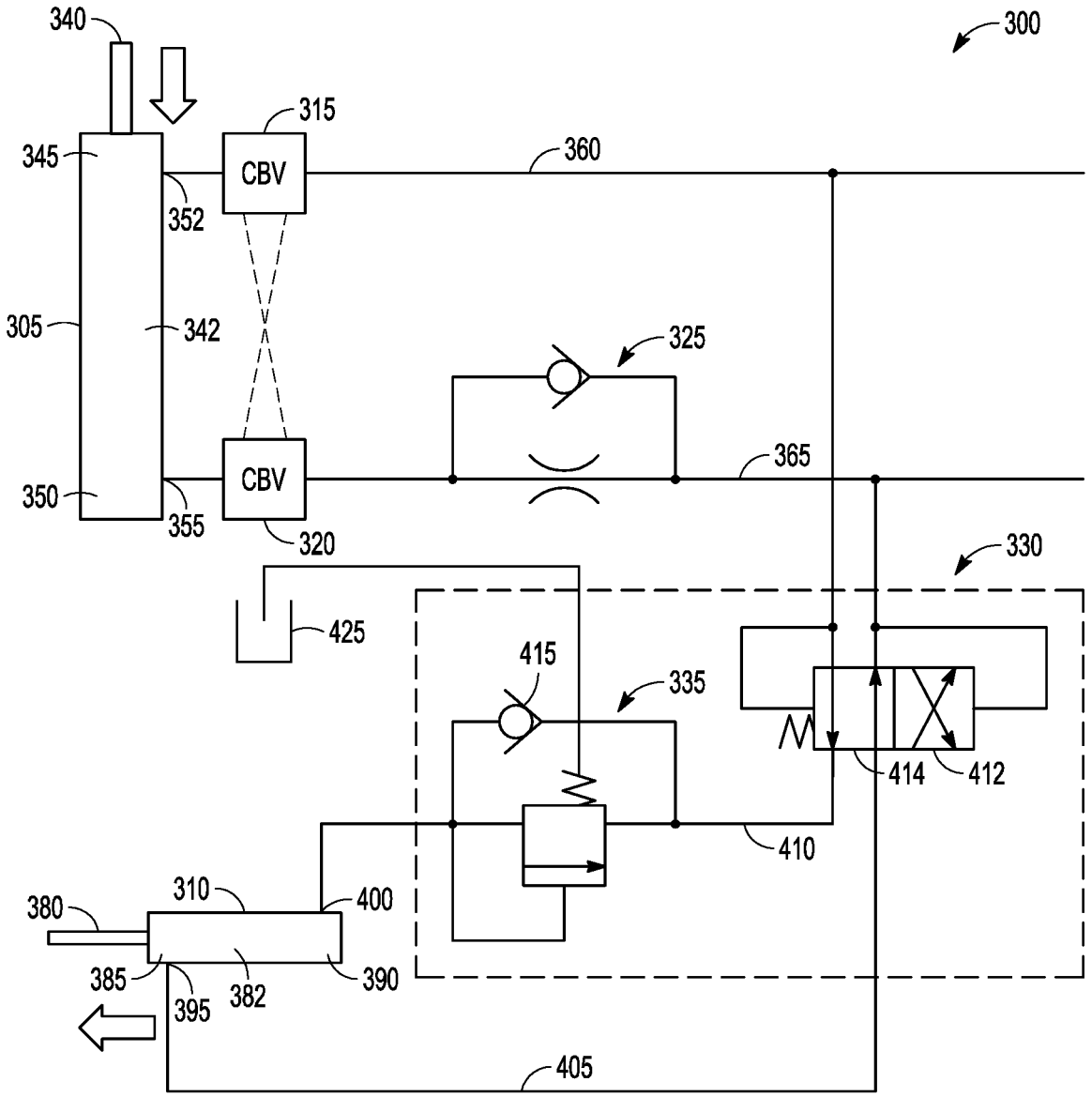
FIG. 4 shows a schematic diagram of a hydraulic circuit for an exemplary mast assembly.

FIGS. 3-4 illustrate a hydraulic circuit 300 of a hydraulic support system for a mast when the mast moves between a 90° degree position to a 105° degree position. In one example, the hydraulic circuit 300 is the hydraulic circuit 300 of the hydraulic support system 145 for mast 105 of FIGS. 1-2.

The hydraulic circuit 300 includes a primary hydraulic cylinder 305, secondary hydraulic cylinder 310, first counterbalance valve (CBV) 315, second CBV 320, relief valve 325, directional valve 330, and relief valve 335. In one example, the primary hydraulic cylinder 305 is either of first primary hydraulic cylinder 160 or second primary hydraulic cylinder 165 of FIGS. 1-2, while the secondary hydraulic cylinder 310 is the secondary hydraulic cylinder 170 of FIGS. 1-2.

The primary hydraulic cylinder 305 includes a rod element 340 secured to a head or piston (not shown) and extends within a primary hydraulic cylinder body 342 from a rod end 345 to a cap end 350. Adjacent the rod end 345 is a first port 352 while adjacent the cap end 350 is a second port 355. Each port 352, 355 is fluidly coupled to a fluid line 360, 365 wherein the first fluid line 360 if fluidly coupled to the first CBV 315 while the second fluid line 365 is fluidly coupled to the second CBV 320. The first and second CBVs 315, 320 function as a relief valves to set up back pressure to prevent load runaway when the piston is retracting.

The secondary hydraulic cylinder 310 also includes a rod element 380 secured to a head or piston (not shown) and extends with a secondary hydraulic cylinder body 382 from a rod end 385 to a cap end 390. Adjacent the rod end 385 is a first port 395 while adjacent the cap end 390 is a second port 400. Each port 395, 400 is fluidly coupled to a fluid line 405, 410 extending from the secondary hydraulic cylinder 310 to the directional valve 330 where the directional valve 330 controls the direction of fluid flow within the fluid lines 405, 410.

The relief valve 325 is disposed within the second fluid line 365 to allow fluid flow from the second CBV 320 to the directional valve 330 and provide pressure relief when fluid is flowing from the directional valve 330 to the second CBV 320. Meanwhile, the first CBV 315 is fluidly connected to the directional valve 330. In addition, the first CBV 315 and second CBV 320 are both fluidly connected to a hydraulic engine via a directional valve (not shown).

In one example, the directional valve 330 is a piloted directional valve or pilot valve. The directional valve 330 in a first position 412 allows fluid to flow from the secondary hydraulic cylinder 310 to the second CBV 320 while fluid from the first CBV 315 flows to the secondary hydraulic cylinder 310. In the second position 414 the directional valve 330 allows fluid to flow from the secondary hydraulic cylinder 310 to the first CBV 315 while fluid from the second CBV 320 flows to the secondary hydraulic cylinder 310.

The relief valve 335 is fluidly disposed between the directional valve 330 and the secondary hydraulic cylinder 310. The relief valve 335 includes a free flow bypass 415, and is also fluidly connected to a tank 425 to provide a vented spring chamber such that when relief flow occurs it is vented to the tank 425.

INDUSTRIAL APPLICATION

When at a worksite, the mast 105 is transported to a desired location. The mast 105 is pivoted from the vehicle into a drilling position to drill at a desired location. When pivoting from the transportation position to a drilling position, up to a predetermined angle such as in one example 90° degrees, the primary hydraulic cylinders 160, 165, 305 are activated and move the mast 105 along a first arc 112 without supplementation. In one example, the first arc 112 is in a range between 0° to 90°. The mast 105 continues to rotate about the pivot axis 110 in the first arc 112 until the mast 105 engages the secondary cylinder 170, 310. At this point the mast rotates about a second arc 114, during which the secondary cylinder reduces the load on the primary cylinder 160, 165, 305. The load is reduced regardless of the direction the mast is rotating along the second arc 114. In one example, the second arc 114 is in a range including and between 90° and 105°.

When moving from 90° degrees to 105° degrees, the directional valve 330 and relief valve 335 of the hydraulic circuit 300 are positioned as provided in FIG. 3 with the directional valve 330 in a first position 412. In particular, when the mast 105 is moving from 90° to 105° degrees, the rod element 180, 340 of the primary hydraulic cylinder(s) 160, 165, 305 moves in the direction of the force the mast 105 is placing on the rod element 180, 340 while the rod element 200, 380 of the secondary hydraulic cylinder 170, 310 similarly moves in the direction of the force the mast 105 is placing on the rod element 200, 380.

In this example, as the rod element 200, 380 of the secondary hydraulic cylinder 170, 310 is pushed into the cylinder body 205, 382 of the secondary hydraulic cylinder 170, 310 the piston of the secondary hydraulic cylinder 170, 310 compresses the fluid at the cap end 195, 390 of the secondary hydraulic cylinder 170, 310. Meanwhile, compressed high pressure fluid (at least 140 pounds per square inch—psi) exists the secondary hydraulic cylinder 170, 310 through port 400 and flows through relief valve 335, through the directional valve 330, to relief valve 325, then second CBV 320, to finally provide fluid pressure into the primary hydraulic cylinder(s) 160, 165, 305 at the second port 355. This pressurized fluid assists in the movement of the piston(s) within the primary hydraulic cylinder(s) 160, 165, 305 such that the rod element 180, 340 extends out of the cylinder body 185, 342 to a desired position.

As a result of the movement of the piston(s) of the primary hydraulic cylinder(s) 160, 165, 305 the fluid within the primary hydraulic cylinder(s) 160, 165, 305 increases such that high pressure fluid exits the first port 352 of the primary hydraulic cylinder(s) 160, 165, 305. This high-pressure fluid then flows to the first CBV 315 that provides pressurized fluid to the second CBV 320 as required. Otherwise, return pressure fluid flows from the first CBV 315 to the hydraulic motor or pump and through the directional valve 330 to supply fluid to the secondary hydraulic cylinder 170, 310.

When moving the mast 105 back from 105° degrees to 90° degrees, the directional valve 330 and relief valve 335 of the hydraulic circuit 300 are positioned as provided in FIG. 4 with the directional valve 330 in a second position 414. In particular, when the mast 105 is moving from 105° to 90° degrees, the rod element 180, 340 of the primary hydraulic cylinder(s) 160, 165, 305 moves in the direction opposite of the force the mast 105 is placing on the rod element 180, 340 while the rod element 200, 380 of the secondary hydraulic cylinder 170, 310 similarly moves in the opposite direction of the force the mast 105 is placing on the rod element 200, 380.

Under this condition, high pressure fluid flows to the first CBV 315 into the primary hydraulic cylinder 160, 165, 305 to retract the rod element 180, 340 of the primary hydraulic cylinder 160, 165, 305 into the cylinder body 185, 342 to rotate the mast 105 about the pivot axis 110. As the piston of the primary hydraulic cylinder 160, 165, 305 moves toward the cap end 175, 350 of the primary cylinder 160, 165, 305 fluid exits the second port 355 of the primary hydraulic cylinder 160, 165, 305 to the relief valve 325 to provide return fluid. Contemporaneously, the high-pressure fluid flow also flows through the directional valve 330 to the relief valve 335 to introduce the high-pressure fluid to the cap end 195, 390 of the secondary hydraulic cylinder 170, 310. Consequently, the rod element 200, 380 of the secondary hydraulic cylinder 170, 310 provides a supplemental force on the mast 105 to rotate the mast 105 about the pivot axis 110. Return fluid is then displaced from the secondary hydraulic cylinder 170, 310 at the rod end 190, 385 of the secondary hydraulic cylinder 170, 310 through port 395. This return fluid flows through the directional valve 330 to combine with the return fluid from the primary hydraulic cylinder 160, 165, 305 to a hydraulic pump or motor.

Thus provided is a hydraulic circuit 300 with a primary hydraulic cylinder 160, 165, 305 for pivoting a mast 105 about a pivot axis 110 and a secondary hydraulic cylinder 170, 310 for supplementing and reducing forces on the primary hydraulic cylinder 160, 165, 305. Within the hydraulic circuit 300, a directional valve 330 and relief valve 335 are arranged between the primary hydraulic cylinder 160, 165, 305 and secondary hydraulic cylinder 170, 310 to control fluid flow to, from, and between the working cylinders. When the mast 105 is moving from 90° to 105° degrees, the directional valve is in a first position 412 such that high-pressure fluid is provided from the cap end 195, 390 of the secondary hydraulic cylinder 170, 310 to supplement the primary hydraulic cylinder 160, 165, 305. When the mast 105 is moving from 105° to 90° degrees the directional valve 330 is in a second position 414, again resulting in high pressure at the cap end 195, 390 of the secondary hydraulic cylinder 170, 310, only this time flow is reversed and high-pressure fluid is provided to the cap end 195, 390 of the secondary hydraulic cylinder 170, 310. In this manner the secondary hydraulic cylinder 170, 310 counteracts the force of the mast 105 to supplement the primary hydraulic cylinder 160, 165, 305. Therefore, both the primary hydraulic cylinder 160, 165, 305 and secondary hydraulic cylinder 170, 310 provide forces, including hydraulic and mechanical forces, to rotate the mast 105 about the pivot axis 110. Specifically, the arrangement of the circuit 300 ensures that pressure at the cap end 390 of the secondary hydraulic cylinder 170, 310 is greater than the pressure on the rod end 385 of the secondary hydraulic cylinder 170, 310, during all operation conditions. Consequently, the secondary hydraulic cylinder 170, 310 reduces and minimizes forces on the primary hydraulic cylinder 160, 165, 305 reducing wear, fatigue, and malfunction.

It will be apparent to those skilled in the art that various modifications and variations can be made to the disclosed hydraulic circuit 300 without departing from the scope of the disclosure. Other embodiments of the hydraulic circuit 300 will be apparent to those skilled in the art from consideration of the specification and practice of the methods disclosed herein. It is intended that the specification and examples be considered as exemplary only, with a true scope of the disclosure being indicated by the following claims and their equivalents.

What is claimed is:

1. A mast assembly comprising:

a mast having a first end and a second end;

a hydraulic circuit for moving the mast comprising:

a primary hydraulic cylinder extending from a rod end to a cap end, the rod end coupled to the first end of the mast to rotate the mast about a pivot axis;

a secondary hydraulic cylinder extending from a rod end to a cap end, fluidly coupled to the primary hydraulic cylinder, the rod end attached to the second end of the mast and the cap end directly attached to the cap end of the primary hydraulic cylinder at a joint connection; and a directional valve fluidly coupled between the primary hydraulic cylinder and secondary hydraulic cylinder to maintain a pressure on the cap end of the secondary hydraulic cylinder greater than a pressure on the rod end of the secondary hydraulic cylinder in a first position and in a second position.

2. The assembly of claim 1, wherein the directional valve is a piloted valve.

3. The assembly of claim 1, wherein the hydraulic circuit further comprises:

a relief valve fluidly coupled between the cap end of the secondary hydraulic cylinder and the directional valve and including a bypass to permit flow of fluid between the directional valve to the cap end of the secondary hydraulic cylinder.

4. The assembly of claim 3, wherein the relief valve includes a vented spring chamber that is fluidly connected to a tank.

5. The assembly of claim 1, wherein in a first position fluid flows through the directional valve to the rod end of the secondary hydraulic cylinder and in a second position fluid flows through the direction valve to the cap end of the secondary hydraulic cylinder.

6. The assembly of claim 1, wherein the primary hydraulic cylinder extends from a rod end to a cap end and the secondary hydraulic cylinder is fluidly coupled to the cap end of the primary hydraulic cylinder.

7. The assembly of claim 6, wherein the rod end of the primary hydraulic cylinder is movably coupled to the mast.

8. The assembly of claim 1, wherein the hydraulic circuit further comprises:

a relief valve fluidly coupled between the primary hydraulic cylinder and the directional valve.

9. A mast assembly comprising:

a mast rotatable about a pivot axis at an angle ranging from zero degrees to 105 degrees to move the mast from a transport position to a drilling position;

a primary hydraulic cylinder attached to a first end of the mast via a joint connection to rotate the mast about the pivot axis;

a secondary hydraulic cylinder extending from a rod end to a cap end, fluidly coupled to the primary hydraulic cylinder, attached to a second end of the mast at the rod end to support the mast when the angle is between 90 degrees and 105 degrees, and directly attached at the cap end to the primary hydraulic cylinder via a joint connection;

a directional valve fluidly coupled between the primary hydraulic cylinder and the rod end of the secondary hydraulic cylinder; and a relief valve coupled between the directional valve and the cap end of the secondary hydraulic cylinder.

10. The hydraulic circuit of claim 9, wherein the directional valve is a piloted valve.

11. The hydraulic circuit of claim 9, wherein the relief valve includes a bypass to permit flow of fluid between the directional valve and the cap end of the secondary hydraulic cylinder.

12. The hydraulic circuit of claim 11, wherein the relief valve includes a vented spring chamber that is fluidly connected to a tank.

13. The assembly of claim 9, wherein the primary hydraulic cylinder extends from a rod end to a cap end and the secondary hydraulic cylinder is fluidly coupled to the cap end of the primary hydraulic cylinder.

14. The assembly of claim 9 wherein the secondary hydraulic cylinder includes a first port at the rod end of the second hydraulic cylinder and a second port at the cap end of the second hydraulic cylinder and fluid pressure at the first port is less than fluid pressure at the second port when the directional valve is in a first position and when the directional valve is in a second position.

15. A method of pivoting a mast through working positions comprising:

activating a primary hydraulic cylinder to move a mast through a first arc in a range between 0 degrees and 90 degrees;

engaging a secondary hydraulic cylinder with the mast as the mast moves through a second arc in a range between 90 degrees and 105 degrees;

reducing load on the primary hydraulic cylinder with the secondary hydraulic cylinder as the mast moves through the second arc;

shifting a directional valve fluidly coupled between the primary hydraulic cylinder and the secondary hydraulic cylinder between a first position to a second position in response to a change of direction of movement of the mast through the second arc; and wherein in a first position fluid flows through the directional valve to the rod end of the secondary hydraulic cylinder and in a second position fluid flows through the direction valve to the cap end of the secondary hydraulic cylinder.

16. The method of claim 15, wherein pressure at a cap end of the secondaty hydraulic cylinder is greater than the pressure at a rod end of the secondary hydraulic cylinder when the directional valve is in the first position and when the directional valve is in the second position.

* * * * *